US008468760B1

(12) United States Patent
Nolte

(10) Patent No.: US 8,468,760 B1
(45) **Date of Patent: *Jun. 25, 2013**

(54) BLAST-RESISTANT FOUNDATIONS

(71) Applicant: Roger Allen Nolte, Concord, NC (US)

(72) Inventor: Roger Allen Nolte, Concord, NC (US)

(73) Assignee: Kontek Industries, Inc, Kannapolis, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/629,554

(22) Filed: Sep. 27, 2012

Related U.S. Application Data

(63) Continuation of application No. 12/912,166, filed on Oct. 26, 2010, now Pat. No. 8,302,357.

(51) Int. Cl.
*E02D 27/00* (2006.01)

(52) U.S. Cl.
USPC ..... 52/294; 52/296; 52/220.2; 52/220.3; 52/604

(58) Field of Classification Search
USPC ..... 52/295, 292, 294, 296, 297, 293.2, 52/293.3, 220.2, 220.3, 220.8, 604, 651.01, 52/651.07; 405/229
See application file for complete search history.

(56) References Cited

U.S. PATENT DOCUMENTS 1,002,051 A * 8/1911 Fessenden ..... 343/885
1,447,942 A 3/1923 Fitzgerald
1,529,895 A 3/1925 Chance et al.
2,184,940 A 12/1939 Cork
2,367,146 A 1/1945 Siebs
2,772,560 A * 12/1956 Neptune ..... 52/707
3,334,557 A * 8/1967 Fitzgibbon ..... 404/64
3,396,502 A 8/1968 Contevita
3,452,493 A 7/1969 Mims
3,549,781 A * 12/1970 Jones ..... 174/486
3,599,378 A 8/1971 Kachnic
3,629,986 A 12/1971 Klittich
3,780,480 A * 12/1973 Cvijanovic et al. ..... 52/223.4
3,905,166 A 9/1975 Kaiser
4,328,651 A * 5/1982 Gutierrez ..... 52/293.1
4,413,455 A * 11/1983 Jenkins ..... 52/295
4,649,675 A 3/1987 Moldovan
4,854,094 A * 8/1989 Clark ..... 52/79.1
4,899,500 A 2/1990 Miller (Continued)

OTHER PUBLICATIONS

This application is a Continuation Application of co-pending parent U.S. Appl. No. 11/912,166, filed Oct. 26, 2010 and also titled, "Blast-Resistant Foundations", This Continuation Application is related to a simultaneously filed, co-pending Division Application and having the same parent.

*Primary Examiner* — Robert Canfield
*Assistant Examiner* — Brent W Herring
(74) *Attorney, Agent, or Firm* — Barclay J. Tullis

(57) ABSTRACT

Blast-resistant foundations are presented that can be used to support a tower, a building, a building supporting a tower, and a tower supporting a building. These foundations can be transported to an installation site and rapidly deployed. They are comprised of one or more precast foundation blocks that do not penetrate the ground beneath them, do not require adjacent foundation blocks to be bound to one-another at their sides with interconnecting steel, and do not require the buildings and/or towers they support to use guy-wires. They can include protected cavities that contain utility equipment and supplies, and they can include conduits from these cavities that can be extended upward through one or more legs of a tower.

20 Claims, 4 Drawing Sheets

U.S. PATENT DOCUMENTS

| | | | | |
|---|---|---|---|---|
| 4,951,433 | A | 8/1990 | Miller | |
| 5,083,404 | A * | 1/1992 | Schulte | 52/167.1 |
| 5,152,108 | A * | 10/1992 | Madl, Jr. | 52/126.1 |
| 5,379,562 | A * | 1/1995 | Hohmann | 52/295 |
| 5,531,419 | A | 7/1996 | Gustafsson | |
| 5,533,835 | A | 7/1996 | Angelette | |
| 5,740,645 | A | 4/1998 | Raby | |
| 6,006,487 | A | 12/1999 | Leek | |
| 6,076,319 | A | 6/2000 | Hendershot et al. | |
| 6,131,349 | A | 10/2000 | Hill | |
| 6,176,055 | B1 | 1/2001 | Fu | |
| 6,282,856 | B1 * | 9/2001 | MacKarvich | 52/299 |
| 6,457,280 | B1 | 10/2002 | Park | |
| 6,462,277 | B1 | 10/2002 | Young et al. | |
| 6,491,468 | B1 | 12/2002 | Hagen | |
| 6,557,312 | B2 | 5/2003 | McGinnis | |
| 6,619,601 | B1 * | 9/2003 | Vall | 248/188 |
| 6,702,522 | B2 | 3/2004 | Silber | |
| 6,718,711 | B1 | 4/2004 | Gilman | |
| 6,935,083 | B2 * | 8/2005 | Chezum | 52/511 |
| 6,948,885 | B2 * | 9/2005 | Blazevic | 405/230 |
| 6,994,048 | B1 * | 2/2006 | Jennings | 114/266 |
| 7,086,209 | B1 * | 8/2006 | Pruitt et al. | 52/745.13 |
| 7,438,324 | B2 | 10/2008 | Keiper | |
| 7,536,831 | B2 | 5/2009 | Ratliff | |
| 7,644,548 | B2 * | 1/2010 | Guevara et al. | 52/223.1 |
| 2005/0183363 | A1 * | 8/2005 | Silber | 52/296 |
| 2008/0098678 | A1 * | 5/2008 | Phillip | 52/294 |
| 2010/0095617 | A1 | 4/2010 | Scholte-Wassink | |

* cited by examiner

BLAST-RESISTANT FOUNDATIONS

CROSS-REFERENCE TO RELATED APPLICATIONS

This application is a Continuation Application of U.S. Pat. No. 8,302,357 titled, "Blast-Resistant Foundations", filed Oct. 26, 2010 and incorporated herein. This Continuation Application is related to a simultaneously filed, co-pending Division application Ser. No. 13/629,594 and having the same parent.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to blast-resistant and collision-withstanding foundations for buildings without basements, for towers, and for towers supporting elevated buildings.

2. Description of the Related Art

In the prior art, buildings without basements are often supported by foundations comprising concrete walls under the perimeter of a building along with piers at selected locations interior to that perimeter. Such foundation walls are often made of stacked precast bricks or building blocks, wherein each brick or block is smaller than approximately 50 centimeters in any canonical direction. And such foundation walls are often supported by concrete footers poured on-site into a trench prepared in the supporting ground. An approximate example of one such foundation system is disclosed in U.S. Pat. No. 7,591,110 by Lane. Another common foundation for buildings without basements comprises one or more slabs of concrete poured on-site over a graded top-surface of supporting ground. One example of a concrete slab foundation is disclosed in U.S. Pat. No. 5,540,524 by Gonsalves.

Foundations for towers are typically comprised of four concrete pads, or of solid concrete blocks, spaced well apart and placed under respectively four legs of a tower. Anchor bolts set into drilled holes are often used to secure the feet of a tower to its foundation. U.S. Pat. No. 2,184,940 by Cork discloses a tower foundation of widely separated concrete blocks. U.S. Pat. No. 6,557,312 B2 by McGinnis discloses a foundation for a tower wherein the foundation is a radial array of prefabricated buildings connected near their inner corners to each other and needing no fabricated support surface beneath the buildings.

Foundations for towers without guy-wires and that support elevated buildings are usually piers driven or poured deep into the ground. U.S. Pat. No. 5,826,387 by Henderson discloses a pier foundation for supporting a tower, although he does not disclose supporting a building on top of a tower.

The prior art does not disclose a foundation without ground-penetrating support elements and that supports a guard house on top of a tower without guy wires. And none of the prior art is sufficient to withstand ramming attacks by terrorist vehicles or explosive blasts by acts of terrorism. What is needed are foundations that can be quickly and efficiently installed from previously fabricated and ready-to-install elements, without requirements for ground-penetrating support elements, and which can withstand ramming attacks by terrorist vehicles and explosive blasts by acts of terrorism.

BRIEF SUMMARY OF THE INVENTION

The invention is pointed out with particularity in the appended claims. However, some aspects of the invention are summarized in the following descriptions of some possible implementation examples and aspects.

One implementation of the invention includes a foundation assembly comprising two or more precast blocks, wherein each of the blocks measures greater than one meter in size in each of two orthogonal directions, and at least one mounting stud extending upward from a top surface of at least one of the blocks, wherein sealant material covers gaps between the blocks. The material comprising most of the bulk of a block can be precast concrete. Reinforcing steel embedded within the concrete may be used to strengthen a block. The bottom surface of each block can be free of attachment to any poured or manufactured foundation pier or footing within the ground. Each block can have a bottom surface that contacts a top surface of supporting ground. The two or more blocks are typically not bound to one-another except indirectly by way of the at least one mounting stud or by the sealant material. At least one conduit can pass through the top surface with the at least one mounting stud. The at least one mounting stud can be one of an array of four mounting studs surrounding the at least one conduit. The top surface of at least one of the blocks can include a removable cover to close a cavity within that block from an outside environment. Examples of what such a cavity can contain include a power supply, an electrical distribution panel, a container of compressed gas, a container of liquid, a container for waste material, and a communications connector. The foundation assembly can support a building, a tower, a tower with a building on top of the tower, or a building with a tower on top of the building. Within an implementation of a foundation supporting a tower that supports a building, the implementation can further comprise: a) at least one utility compartment inside one of the blocks; b) a conduit running from the utility compartment and upward through the top surface of at least one of the blocks; c) at least one leg of the tower; and d) an extension of the conduit, wherein the extension runs inside the leg and into the building.

Another implementation of the invention includes an individual precast block assembly comprising: a) a block of concrete having a top surface and a bottom surface; b) a structure of reinforcing steel within the concrete; c) a cavity within the concrete large enough to contain a cube measuring 15 centimeters on a side; d) an array of mounting studs extending upward from the top surface of the concrete; and e) a conduit passing through the top surface at a location within the array of mounting studs; wherein the bottom surface is substantially planar and free of any penetrating object. Within such an implementation, the block can be a foundation element supporting a building, the bottom surface can be substantially co-planar with a top-most surface of ground supporting the block, and the block can be free of any attachment to any neighboring block using any steel attachment or connecting element.

The invention also includes a foundation building method, an example of which comprises steps of: a) precasting two or more concrete blocks each with a top and a bottom surface, wherein at least two of the blocks each has at least two mounting studs jutting upward from its top surface, and wherein at least one of the at least two of the blocks has a conduit extending through its top surface at a location between its at least two mounting studs; b) transporting the at least two of the concrete blocks to a building site; c) placing the at least two of the concrete blocks with the bottom surface of each on top of supporting ground leaving gaps between blocks that are adjacent to one-another; and d) sealing over the gaps otherwise visible from above and beside the blocks.

OBJECTS AND ADVANTAGES OF THE INVENTIONS

Objects and advantages of the present inventions include foundations that can be used to support a tower, a building, a building supporting a tower, and a tower supporting a building. These foundations can be transported to an installation site and rapidly deployed. They are comprised of multiple precast foundation blocks that do not penetrate the ground beneath them, do not require adjacent foundation blocks to be bound to one-another at their sides with interconnecting steel, and do not require the buildings and/or towers they support to use guy-wires. They can include protected cavities that contain utility equipment and supplies, and they can include conduits from these cavities that can be extended upward through one or more legs of a tower.

The various features and further advantages of the present inventions and their preferred embodiments will become apparent to ones skilled in the art upon examination of the accompanying drawings and the following detailed description. It is intended that any additional advantages be incorporated herein. The contents of the following description and of the drawings are set forth as examples only and should not be understood to represent limitations upon the scope of the present invention.

BRIEF DESCRIPTION OF THE SEVERAL VIEWS OF THE DRAWINGS

The foregoing objects and advantages of the present invention of blast-resistant foundations comprising foundation blocks may be more readily understood by one skilled in the art with reference being had to the following detailed description of several embodiments thereof, taken in conjunction with the accompanying drawings. Within these drawings, callouts using like reference numerals refer to like elements in the several figures (also called views) where doing so won't add confusion. Within these drawings.

DETAILED DESCRIPTION OF THE INVENTION

Figure 1:
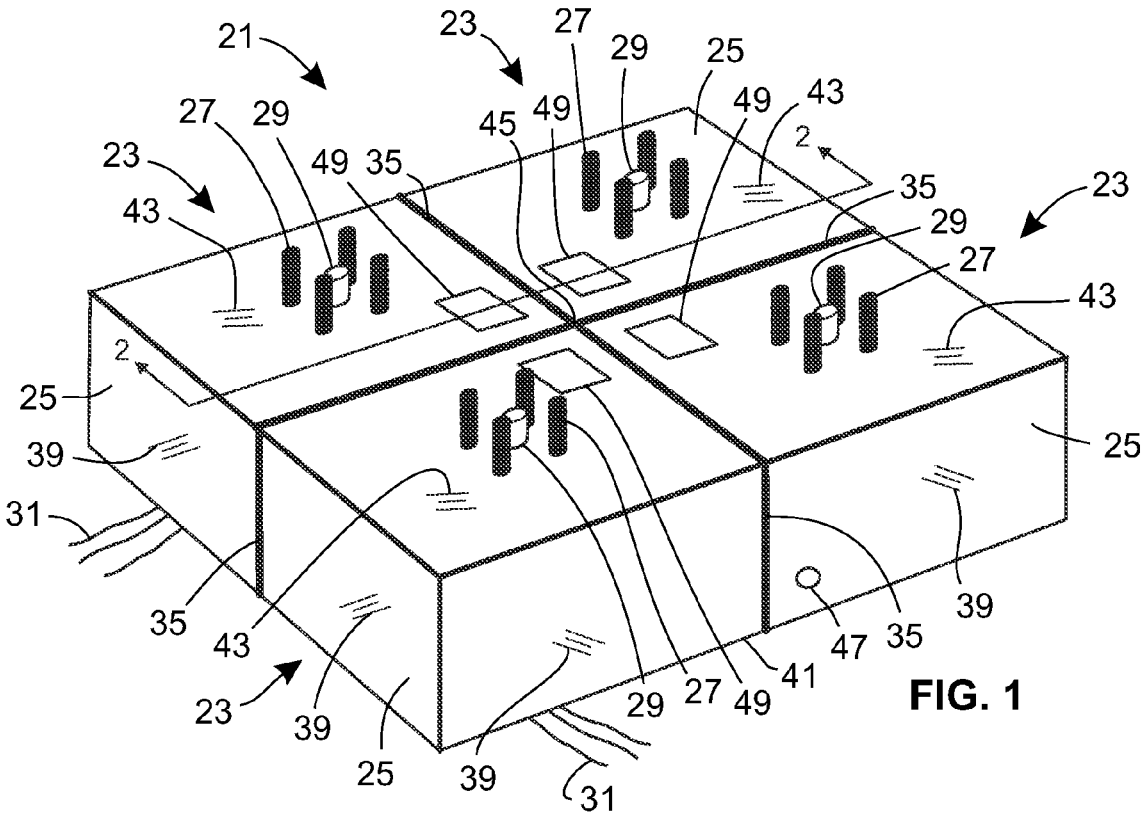
FIG. 1 shows a perspective view of a blast-resistant foundation assembly comprising four adjacent precast blocks resting on top of the ground without elements penetrating the ground, and without steel attachment elements attaching one block to one-another.

The following is a detailed description of the invention and its preferred embodiments as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims.

Figure 2:
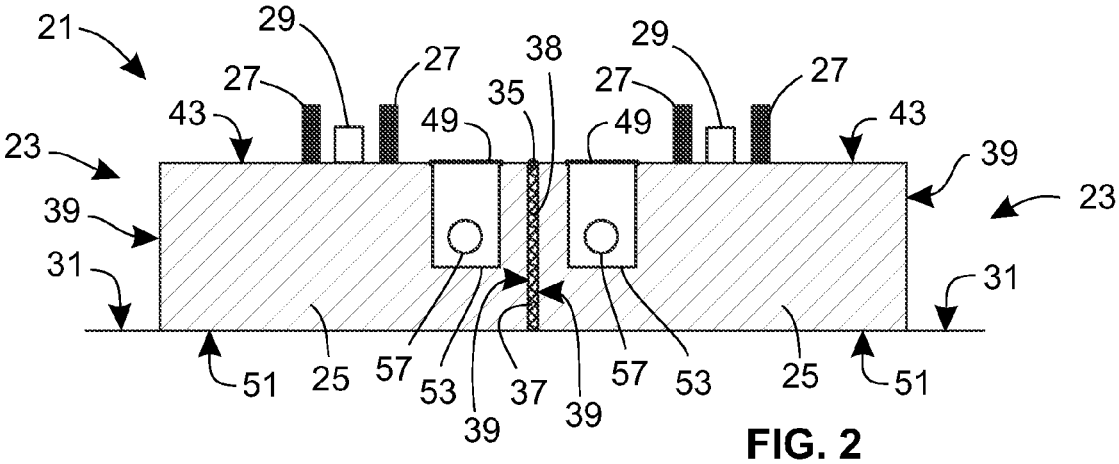
FIG. 2 shows a cross-section of the foundation assembly.

FIG. 1 shows a perspective view of a blast-resistant foundation assembly 21 comprising four adjacent precast blocks (each designated with the callout number 23). Each block 23 comprises a top surface 43, four sides 39, and a bottom surface 51. Each block 23 in a foundation assembly 21 rests with its bottom surface 51 (see FIG. 2) in contact with the top of a supporting ground surface 31; the blocks 23 do not need to sit in a dug-out recess in the ground surface 31. The ground surface 31 may however comprise compacted gravel or other grading material. There are no foundation strengthening elements extending downward from the bottom surface 51 and penetrating the ground, and there are no steel attachment elements through the sides 39 of the blocks attaching one block to another. Each block 23 is located side-by-side with at least one other block 23. In the implementation shown, four blocks are arranged in a two-dimensional rectangular array with inner-facing corners nearly touching one-another at a location 45. Sealant 35 protects gaps 37 that are between the blocks 23, protecting them from downward and sideways entry by environmental elements or by terror-related encroachments (a gap 37 is shown in FIG. 2). In some implementations, the body 25 of each block is made of concrete. Whether made of concrete or not, the body 25 is precast at a different location than that of its installation as part of a foundation. Extending from the top surface 43 of each block shown are four mounting studs 27 spaced apart from one-another and about the location of a conduit section 29 which also extends through the top surface 43 of each block shown. An advantage of this implementation is that each block can support a leg of a tower by means of the four mounting studs 27, and the conduit section 29 can be extended upward along the interior of the leg for protection of the conduit from damage by things outside the leg (see FIG. 5).

Also shown in FIG. 1 is a block 23 having a conduit port 47. This conduit port 47 can be part of a conduit 57 (see FIG. 2) that runs to a utility cavity 53 (see FIG. 2) within the block 23. Each block 23 can have a utility access door 49 providing access to such a utility cavity 53. One or more access doors 49 can be provided for each block 23 that contains one or more cavities 53, and these access doors 49 can be located on any surface of a block 23, including a top surface 43, a bottom surface 51, or a block side 39 surface.

FIG. 2 shows a cross-section of the foundation assembly. The cross-sectional view taken is that indicated by the arrows numbered "2" in FIG. 1. This view shows the supporting ground surface 31 and the bottom surface 51 of the blocks contacting the supporting ground surface 31. This view also shows a gap 37 that is defined by two oppositely facing sides 39 of blocks 23 where they are aligned next to one-another wherein the gap 37 between the blocks 23 is small relative to a width of a side 39 of any of the blocks 23. The gap 37 is filled with a gap filler 38 such as sand. Sealant 35 is shown covering the gap from things that could otherwise enter from above the foundation assembly 21. Sides 39 that are not facing one another are shown facing open air. And a utility cavity 53 is shown in each block 23, where each cavity is covered by a utility access door 49, and a conduit 57 intersects the inner space of each cavity.

Figure 3:
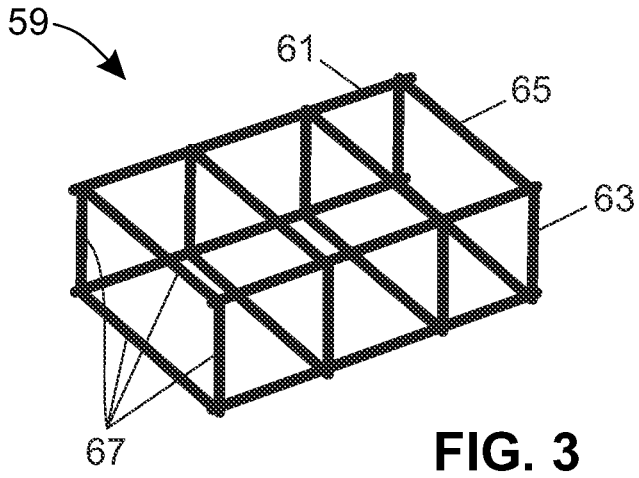
FIG. 3 shows a perspective view of a cage of reinforcing steel bars used with a precast block.

FIG. 3 shows a perspective view of a rebar cage 59 of reinforcing steel bars as used in some embodiments of a precast block 23. The rebar cage 59 is shown in this example as comprising longitudinal bars 61 connected to vertical bars 63 and to horizontal cross bars 65. In this example, horizontal cross bars 65 and vertical bars 63 make up loops 67. Four such loops 67 are shown in this example, interconnected by four longitudinal bars 61. Other embodiments that use reinforcement to strengthen the concrete body 25 of a block can use alternative materials such as woven mesh of metal, plastic, and/or fibers such as fiber-glass.

Figure 4:
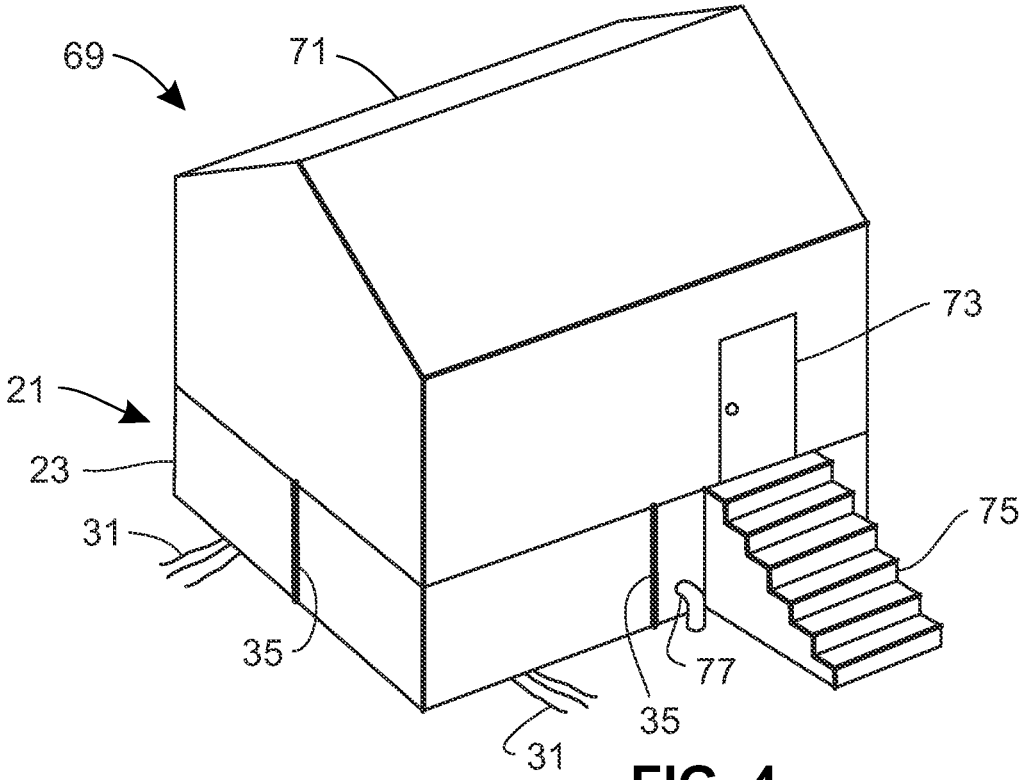
FIG. 4 shows a perspective view of a building supported by a foundation assembly.

FIG. 4 shows a perspective view of a building 71 on a foundation assembly 21, the combination being a building on a foundation assembly 69. The building 71 includes a door 73. A stairway 75 is shown leading from the supporting ground surface 31 to the threshold of the door 73. A conduit 77 is shown connected between one of the blocks 23 of the foundation assembly 21 and the supporting ground surface 31. The embodiment of the foundation assembly 21 is similar to that described above and shown in FIGS. 1 and 2. The building 71 can be secured to the foundation assembly 21 by means of the mounting studs 27 (shown in FIG. 1). And utilities can be fed into the building 71 by way of the conduit sections 29 (shown in FIG. 1). Utility supplies and hardware can be kept in the utility cavities 53 (shown in FIG. 2).

Figure 5:
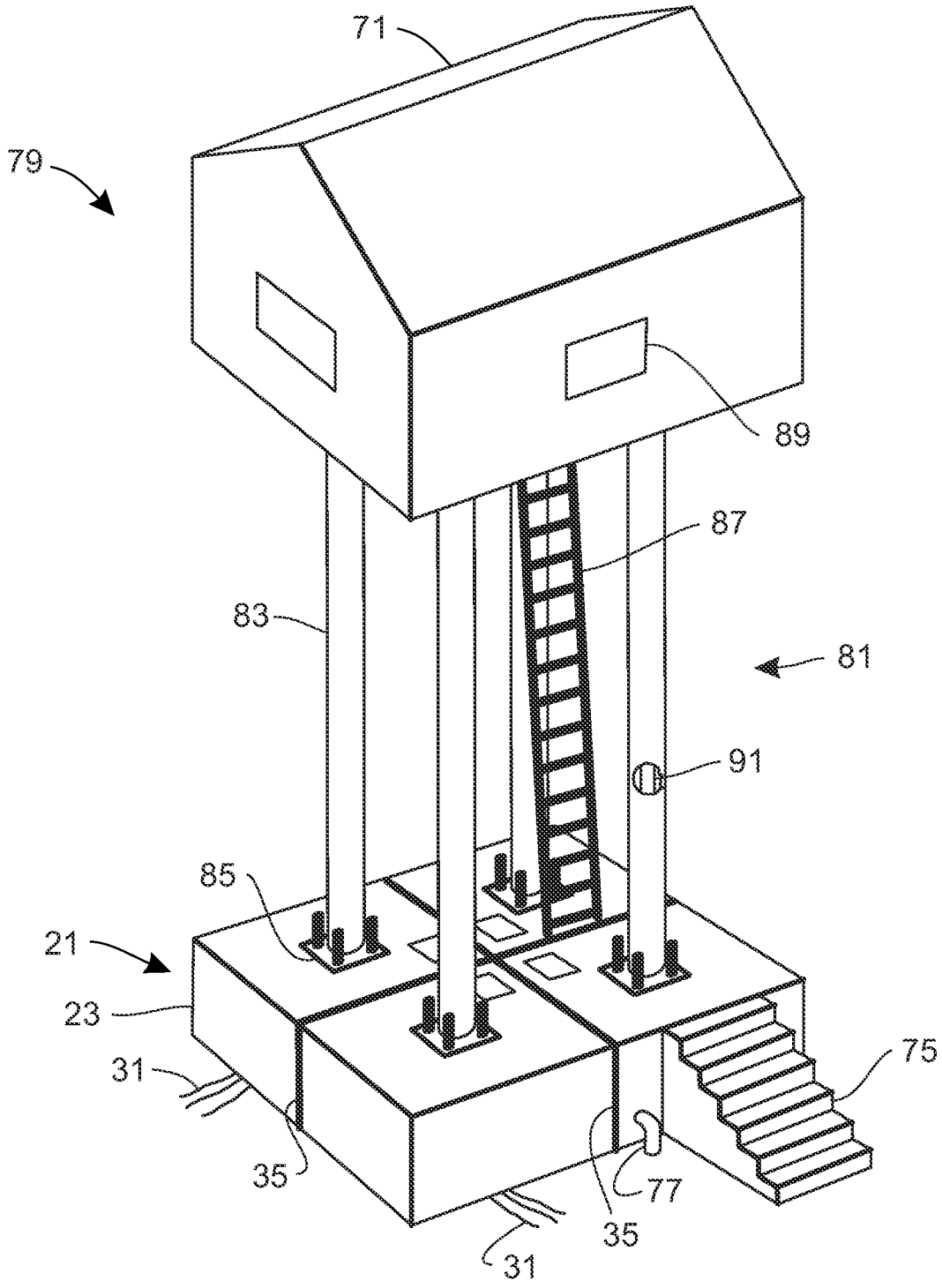
FIG. 5 shows a perspective view of a building supported on top of a tower that is in turn supported on top of a foundation assembly.

FIG. 5 shows a perspective view of an assembly 79 of a building 71 supported on top of a tower 81 that is in turn supported on top of a foundation assembly 21. The embodiment of the foundation assembly 21 is similar to that described above and shown in FIGS. 1, 2, and 4. The tower 81 includes tower legs 83 fastened to the foundation assembly 21 by means of the feet 85 at the bottoms of the legs 83, and by means of the mounting studs 27 on top of the foundation assembly 21. A ladder 87 provides a means of human access from the foundation assembly 21 to the building 71. The building 71 is shown to include at least one window 89. A conduit extension 89 is shown running up the interior of a leg 83, as viewed in this illustration through a drawing cut-out in the leg 83. The conduit extension 89 connects utility supplies and hardware in a utility cavity 53 (see FIG. 2) within a block 23 to the building 79.

Figure 6:
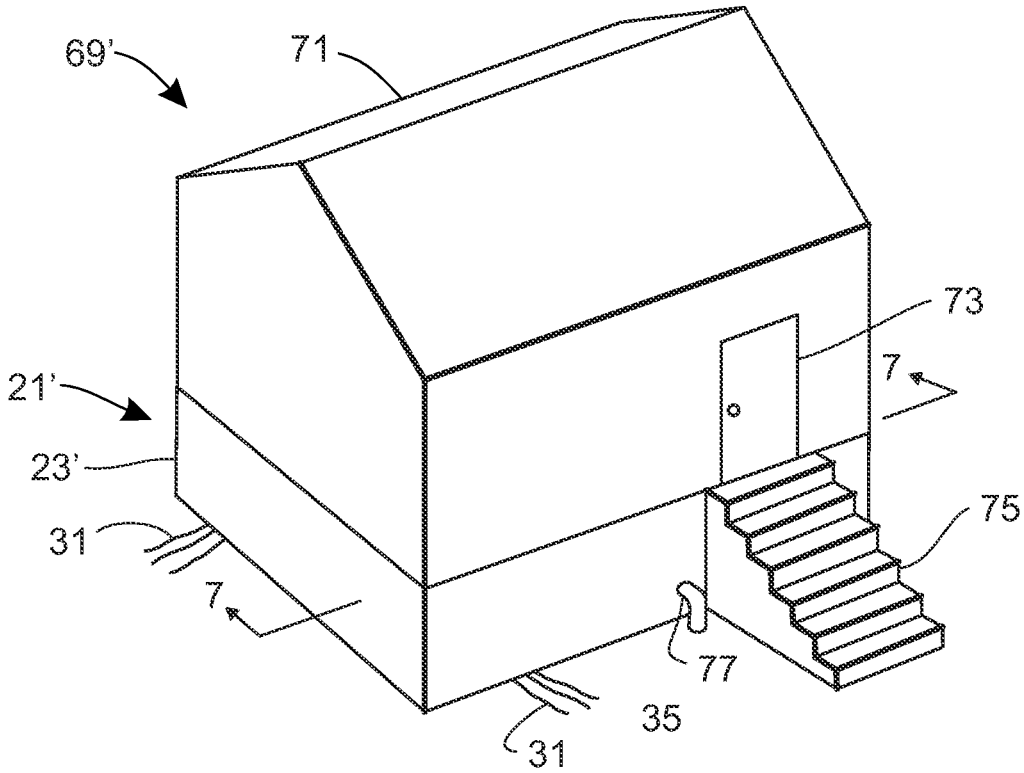
FIG. 6 shows a perspective view of a building supported by a foundation assembly having only one precast block.

FIG. 6 shows a perspective view of a building 71 on a foundation assembly 21', wherein the foundation assembly 21' is made from only one precast block, the combination being a building on a foundation assembly 69'. The embodiment of the foundation assembly 21' is similar to that described above and shown in FIG. 4 except for the foundation assembly 21' having only one precast block 23' rather than four precast blocks. The building 71 can be secured to the foundation assembly 21' by means of mounting studs 27 extending from the top of the block (similar to studs 27 shown in FIG. 1). And utilities can be fed into the building 71 by way of a conduit section 29 (similar to a conduit section 29 shown in FIG. 1). Utility supplies and hardware can be kept in a utility cavity 53 (similar to a cavity 53 as shown in FIG. 2).

Figure 7:
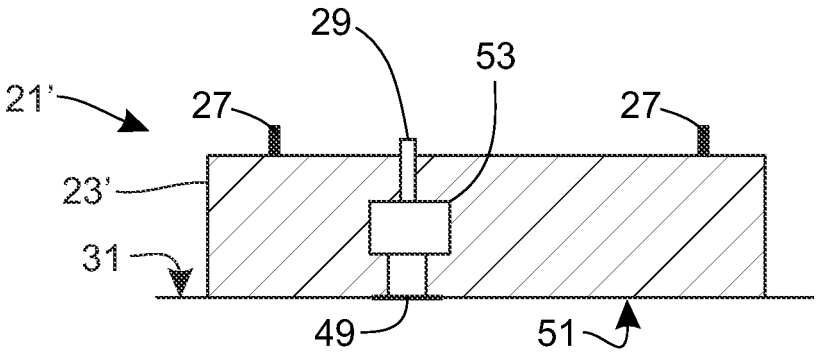
FIG. 7 shows a cross-sectional view of a foundation having a utility cavity and its access door.

FIG. 7 shows an example of a utility access door 49 located on the bottom of the block 23' that is shown in FIG. 6. FIG. 7 is a cross-sectional view of the foundation assembly 21' shown in FIG. 6, with the view taken as indicated by the arrows numbered "7" in FIG. 6. This view shows the supporting ground surface 31 and the bottom surface 51 of the block contacting the supporting ground surface 31. A utility cavity 53 is shown in the block 23', and the utility access door 49 provides access to it. Also shown are a conduit section 29, which intersects the inner space of the cavity 53, and mounting studs 27. Providing an access door 49 beneath a foundation block provides maximum protection against terrorist threats but requires digging to get access to it, and back-filling after any job is completed that required an entry to the cavity 53.

Embodiments of the invention include foundation building methods. One such method comprises steps of: a) precasting two or more concrete blocks each with a top and a bottom surface, wherein at least two of the blocks each has at least two mounting studs jutting upward from its top surface, and wherein at least one of the at least two of the blocks has a conduit extending through its top surface at a location between its at least two mounting studs; b) transporting the at least two of the concrete blocks to a building site; c) placing the at least two of the concrete blocks with the bottom surface of each on top of supporting ground leaving gaps between the blocks; d) filling the gaps with a gap filler such as sand; and e) sealing over the gaps otherwise visible from above and beside the blocks.

Several embodiments are specifically illustrated and/or described herein. However, it will be appreciated that modifications and variations are covered by the above teachings and within the scope of the appended claims without departing from the spirit and intended scope thereof. Method steps described herein may be performed in alternative orders. The examples provided herein are exemplary and are not meant to be exclusive.

Although specific embodiments of the invention have been illustrated and described herein, those of ordinary skill in the art will appreciate that any arrangement configured to achieve the same purpose may be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to those of skill in the art upon reviewing the above description. The scope of various embodiments of the invention includes any other applications in which the above structures and methods are used.

I claim:

1. A blast-resistant foundation assembly comprising four concrete blocks;

wherein each of the blocks is fastened to a tower or building and sits on the ground and not in the ground;

wherein each of the blocks is immediately adjacent to at least one other of the blocks to form a pair of blocks that are side-by-side with distance between those sides considerably smaller than widths of those sides;

wherein each of the blocks is adjacent side-by-side to at least two others of the blocks;

wherein at least one side of one block is not covered by filler material; and wherein the blocks are not bound to one-another through any of their side surfaces.

2. The blast-resistant foundation assembly of claim 1, wherein the foundation assembly supports a building.

3. The blast-resistant foundation assembly of claim 1, wherein the foundation assembly supports a tower.

4. The blast-resistant foundation assembly of claim 3, further comprising:

a. a cavity in one of the blocks; and b. a conduit running from the cavity and upward out of at least one of the blocks;

wherein an extension of the conduit runs inside a leg of the tower.

5. The blast-resistant foundation assembly of claim 3, wherein the tower supports a building.

6. The blast-resistant foundation assembly of claim 1;

wherein each of the blocks includes a top surface, a bottom surface, and three or more side surfaces; and wherein at least one mounting stud extends upward from one of the top surfaces.

7. The blast-resistant foundation assembly of claim 6, wherein each said bottom surface is free of attachment to any poured or manufactured foundation pier or footing within the ground.

8. The blast-resistant foundation assembly of claim 6, further comprising at least one conduit; wherein the conduit extends through the top surface of at least one of the blocks.

9. The blast-resistant foundation assembly of claim 6, further comprising:

a. a cavity within one of the blocks; and b. an access door to the cavity.

10. A blast-resistant foundation assembly comprising three concrete blocks that support at least a portion of the weight of a tower or a building;

wherein each of the blocks includes a top surface, a bottom surface, and one or more side surfaces;

wherein the blocks are arranged side-by-side in two orthogonal directions;

wherein each of the blocks is immediately adjacent to at least one other of the blocks to form a pair of blocks that are side-by-side with distance between those sides considerably smaller than widths of those sides;

wherein at least one side of one block is not covered by filler material;

wherein each of the bottom surfaces contacts the ground without any of the three blocks being in the ground; and wherein the blocks are not bound to one-another through any of their side surfaces.

11. The blast-resistant foundation assembly of claim 10;

wherein each of the blocks measures greater than one meter in size in each of two orthogonal directions.

12. The blast-resistant foundation assembly of claim 10, wherein the foundation assembly supports a building.

13. The blast-resistant foundation assembly of claim 10, wherein the foundation assembly supports a tower.

14. The blast-resistant foundation assembly of claim 13, further comprising:

a. a cavity in one of the blocks; and b. a conduit running from the cavity and upward out of at least one of the blocks;

wherein an extension of the conduit runs inside a leg of the tower.

15. The blast-resistant foundation assembly of claim 13, wherein the tower supports a building.

16. The blast-resistant foundation assembly of claim 10;

wherein at least one mounting stud extends upward from one of the top surfaces.

17. The blast-resistant foundation assembly of claim 10, wherein each said bottom surface is free of attachment to any poured or manufactured foundation pier or footing within the ground.

18. The blast-resistant foundation assembly of claim 10, further comprising at least one conduit; wherein the conduit extends through the top surface of at least one of the blocks.

19. The blast-resistant foundation assembly of claim 10, further comprising:

a. a cavity within one of the blocks; and b. an access door to the cavity.

20. A blast-resistant foundation assembly comprising three concrete blocks that support at least a portion of the weight of a tower or a building;

wherein each of the blocks is secured to the tower or building;

wherein each of the blocks includes a bottom surface and one or more side surfaces;

wherein each of the blocks is immediately adjacent to at least one other of the blocks to form a pair of blocks that are side-by-side with distance between those sides considerably smaller than widths of those sides;

wherein at least one of the blocks is adjacent side-by-side to at least two others of the blocks;

wherein at least one side of one block is not covered by filler material;

wherein each of the bottom surfaces contacts the ground without any of the blocks being in the ground;

wherein the blocks are not bound to one-another through any of their side surfaces; and wherein each said bottom surface is free of attachment to any poured or manufactured foundation pier or footing within the ground.

* * * * *